US006336595B1

(12) United States Patent
Barbier

(10) Patent No.: US 6,336,595 B1
(45) Date of Patent: Jan. 8, 2002

(54) FUEL INJECTOR

(75) Inventor: Philippe Barbier, Cellettes (FR)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/531,259

(22) Filed: Mar. 17, 2000

(30) Foreign Application Priority Data

Mar. 18, 1999 (GB) ..... 9906092

(51) Int. Cl.[7] ..... F02M 47/02

(52) U.S. Cl. ..... 239/88; 239/90; 239/96; 239/124; 239/533.3; 123/467

(58) Field of Search ..... 239/88, 90, 96, 239/124, 553.2, 555.3; 123/467, 516

(56) References Cited

U.S. PATENT DOCUMENTS 3,131,866 A * 5/1964 Cummins et al.
4,161,161 A * 7/1979 Bastenhof ..... 239/533.3
5,803,361 A * 9/1998 Horiuchi et al. ..... 239/88
5,820,033 A * 10/1998 Cooke ..... 239/124
5,901,941 A * 5/1999 Ricco ..... 239/585.3

* cited by examiner

*Primary Examiner*—Kevin Shaver
*Assistant Examiner*—Christopher S. Kim
(74) *Attorney, Agent, or Firm*—John A. VanOphem

(57) ABSTRACT

A fuel injector comprising a valve needle slidable within a bore, a surface associated with the valve needle being exposed to the fuel pressure within a control chamber and an electromagnetically actuable control valve controlling communication between the control chamber and a low pressure chamber. The injector also comprises a damping arrangement arranged to damp pressure waves applied to the low pressure chamber.

2 Claims, 3 Drawing Sheets

FUEL INJECTOR

TECHNICAL FIELD

This invention relates to a fuel injector for use in delivering fuel under pressure to a combustion space of an internal combustion engine. In particular the invention relates to a fuel injector of the electromagnetically actuable type suitable for use in a common rail type fuel system arranged to deliver diesel fuel to a compression ignition internal combustion engine.

BACKGROUND OF THE INVENTION

A known fuel injector for use in such a fuel system is illustrated in FIG. 1 and comprises a valve needle 10 slidable within a bore 11. The needle 10 includes a surface exposed to the fuel pressure within a control chamber 12. The control chamber 12 is supplied with fuel from a supply passage 13 through a restriction 14, thus fuel is only permitted to flow to the control chamber 12 at a restricted rate. An electromagnetically actuable control valve 15 controls communication between the control chamber 12 and a chamber 16 which communicates with a low pressure drain reservoir through a backleak passage which is common to several injectors. The injector of FIG. 1 will be described in greater detail below.

Reliable, consistent operation of the control valve 15 is important to achieve as inconsistencies in the operation of the control valve may result in undesirable variations in the quantity of fuel injected and in the timing of fuel injection. Pressure waves may be transmitted to the control chamber 16 from other identical injectors via the common backleak passage. It will be appreciated that the application of pressure waves to the chamber 16 may impair the performance of the valve. It is an object of the invention to provide an injector in which this disadvantage is obviated or mitigated.

SUMMARY OF THE INVENTION

According to the present invention there is provided a fuel injector comprising a valve needle slidable within a bore, a surface associated with the needle being exposed to the fuel pressure within a control chamber, an electromagnetically actuable control valve controlling communication between the control chamber and a low pressure chamber, and a damping arrangement arranged to damp pressure waves applied to the low pressure chamber.

The damping arrangement conveniently comprises a volume which communicates with the low pressure chamber, the volume containing gas, in use. The gas, for example air, fuel vapour or a mixture thereof, is readily compressible and acts to damp pressure waves applied to the low pressure chamber.

The volume is conveniently defined by a blind drilling orientated, in use, with its blind end uppermost to retain the gas therein. The drilling conveniently extends adjacent part of the actuator for the control valve.

BRIEF DESCRIPTION OF THE DRAWINGS

The invention will further be described, by way of example, with reference to the accompanying drawings, in which.

DESCRIPTION OF THE PREFERRED EMBODIMENT

Figure 1:
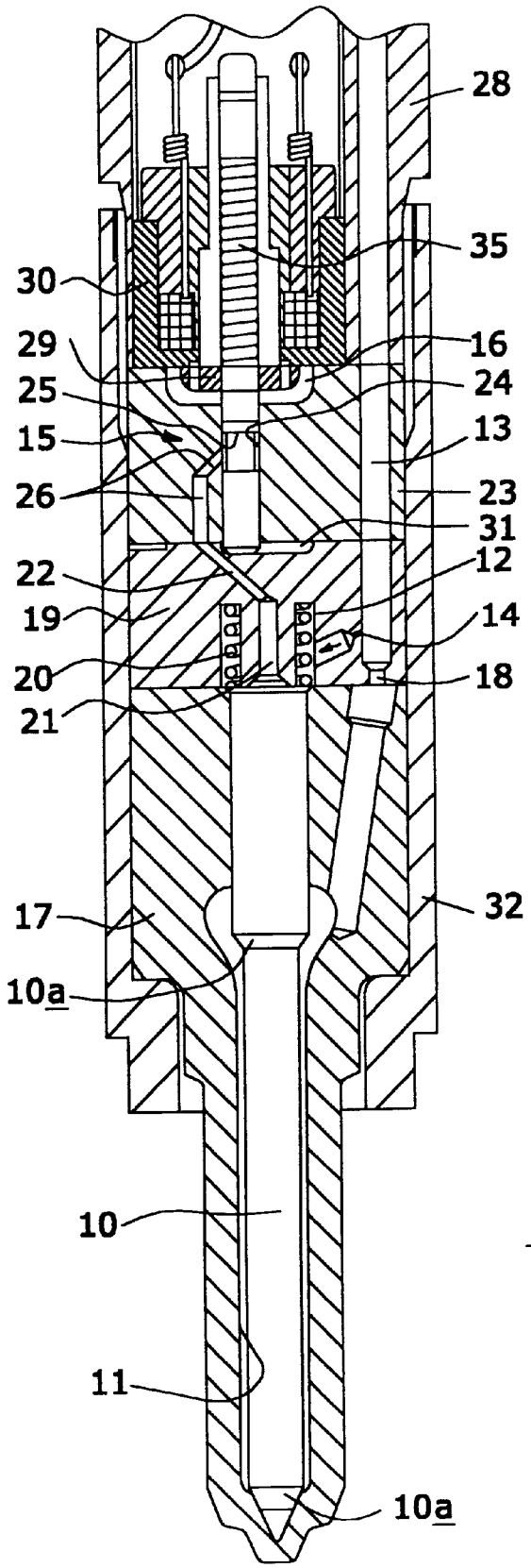
FIG. 1 PRIOR ART
FIG. 1 is a sectional view illustrating a fuel injector.
Figure 2:
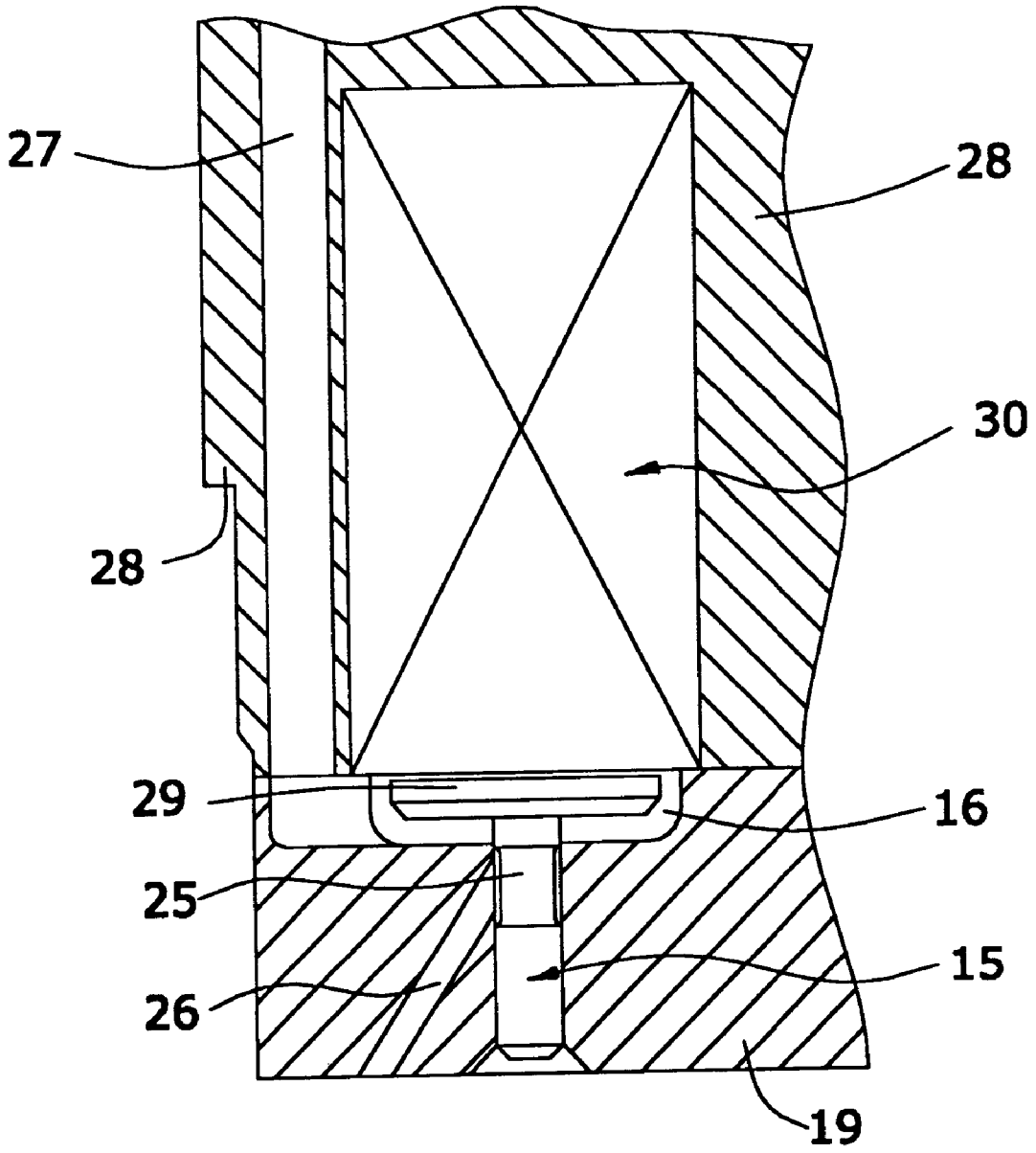
FIG.2 PRIOR ART
FIG. 2 is a diagrammatic view illustrating part of the injector of FIG. 1.

As described briefly hereinbefore, the fuel injector illustrated, in part, in FIGS. 1 and 2 comprises a valve needle 10 which is slidable within a bore 11. The bore 11 takes the form of a blind bore formed in a nozzle body 17. Adjacent the blind end of the bore 11, a plurality of outlet openings (not shown) is provided. The bore 11 is shaped to define a seating with which the needle 10 is engageable to control communication between the region of the bore 11 upstream of the seating and the outlet openings.

The bore 11 is supplied with fuel under high pressure, in use, through the supply passage 13, the supply passage 13 being connected to a fuel source in the form of a common rail which, in use, is charged with fuel to a high pressure by a suitable fuel pump. As illustrated in FIG. 1, the supply passage 13 is shaped to define a region 18 of reduced diameter, the region 18 restricting the rate at which fuel is able to flow along the supply passage 13 towards the bore 11.

The nozzle body 17 abuts a distance piece 19 which is shaped to include a recess which defines the control chamber 12, an upper end surface of the needle 10 being exposed to the fuel pressure within the control chamber 12. As described hereinbefore, the control chamber 12 communicates with the supply passage 13 through a restriction 14. A spring 20 is located within the control chamber 12, the spring 20 acting to apply a biasing force to the needle 10 urging the needle 10 into engagement with the seating. The recess which defines the control chamber 12 is shaped to define an internal projection which serves as a lift stop, controlling the distance through which the needle 10 can lift away from its seating. A drilling 21 is provided within the projection, the drilling 21 communicating through a further drilling 22 with a surface of the distance piece 19 remote from the nozzle body 17. The end of the distance piece 19 remote from the nozzle body 17 abuts a valve housing 23 which is provided with a through bore 24 within which a valve member 25 is moveable. The valve member 25 forms part of the electromagnetically actuated control valve 15. The valve member 25 is shaped to include a region of diameter smaller than the adjacent part of the bore 24, defining an annular chamber which communicates through passages 26 with the drilling 22, and hence with the control chamber 12. The valve member 25 includes a region of enlarged diameter which is engageable with a seating adjacent an end of the bore 24 to control communication between the passages 26 and the low pressure chamber 16. As illustrated in FIG. 2, the low pressure chamber 16 communicates with a return passage 27 provided in an actuator housing 28 which abuts the surface of the valve housing 23 remote from the distance piece 19. The return passage 27 communicates, in use, with a backleak passage (not shown), the backleak passage being common to all of the injectors associated with the engine, the backleak passage further communicating with a low pressure fuel reservoir, for example a fuel tank.

Within the chamber 16, an armature 29 is provided, the armature 29 being secured to the valve member 25 and moveable under the influence of an electromagnetic actuator 30 located within a bore provided in the actuator housing 28. The actuator 30 includes a return spring arranged to bias the valve member 25 into engagement with its seating.

The lower end of the valve member 25 extends into a chamber 31 defined between the valve housing 23 and the distance piece 19, the chamber 31 communicating through a passage (not shown) with an appropriate low pressure fuel reservoir.

A cap nut 32 is used to secure the nozzle body 17, the distance piece 19 and the valve housing 23 to the actuator housing 28 in the usual manner.

In use, as described hereinbefore, the supply passage 13 is arranged to receive fuel under high pressure, and it will be appreciated that provided the actuator 30 is not energized, and hence the valve member 25 engages its seating, then both the bore 11 and the control chamber 12 will have high pressure fuel applied thereto. The fuel pressure within the bore 11 applies a force to appropriately angled thrust surfaces 10*a* of the needle 10, urging the needle 10 away from its seating. The action of the fuel upon the thrust surfaces 10*a* is countered by the action of the fuel under pressure within the control chamber 12 and the action of the spring 20. The fuel pressure within the control chamber 12, which acts over a relatively large effective area of the needle 12, in combination with the action of the spring 20, is sufficient to ensure that the valve needle 10 remains in engagement with its seating.

When injection is to commence, the actuator 30 is energized, urging the armature 29 and valve member 25 to move against the action of the spring 35 of the actuator 30, lifting the valve member 25 away from its seating. As a result, fuel is able to escape from the control chamber 12 to the chamber 16 which, as described hereinbefore, is at relatively low pressure due to its connection with the low pressure reservoir by the return passage 27 and the backleak passage. As fuel is only permitted to flow towards the chamber 12 at a low rate through the restriction 14, it will be appreciated that the fuel pressure within the control chamber 12 falls, and as a result, the force applied to the needle 10 urging the needle 10 towards its seating also falls. A point will be reached beyond which the fuel pressure acting upon the thrust surfaces 10a is sufficient to lift the valve needle 10 away from its seating, thus permitting fuel from the bore 11 to flow past the seating to the outlet openings, and into the combustion space with which the injector is associated.

During injection of fuel, as fuel is permitted to flow towards the bore 11 at a restricted rate through the restriction 18, and as fuel is able to escape from the bore 11 by being injected through the outlet openings, it will be appreciated that the fuel pressure within the bore 11 falls, and thus the magnitude of the force urging the valve needle 10 away from its seating is reduced.

In order to terminate injection, the actuator 30 is de-energized, the valve member 25 returning into engagement with its seating under the action of the spring of the actuator 30. As a result, fuel is unable to escape from the control chamber 12 to the low pressure chamber 16, and as fuel is permitted to flow to the chamber 12 through the restriction 14, the fuel pressure within the control chamber 12 will rise and thus the force urging the needle 10 into engagement with its seating will rise. A point will be reached beyond which the needle 10 moves into engagement with its seating as a result of the fuel pressure within the control chamber 12 and the action of the spring 20 overcoming the action of the fuel under pressure upon the thrust surfaces 10*a*. Once the needle 10 has moved into engagement with its seating, fuel injection terminates. As, during injection, the fuel pressure within the bore 11 falls, it will be appreciated that termination of injection occurs more rapidly than would otherwise be the case. Additionally, it will be appreciated that as the internal projection which serves as a lift stop reduces the volume of the control chamber 12, repressurisation of the control chamber 12 can be achieved relatively quickly, thereby aiding rapid closure of the valve needle 10.

As discussed hereinbefore, the low pressure chamber 16 is connected to a common backleak passage. As a result, there is risk that the operation of other injectors associated with the engine may result in pressure waves being transmitted along the backleak passage and along the return passage 27 to the low pressure chamber 16, and the action of the pressure waves upon the valve member 25 and armature 29 may impair the operation of the control valve 15 such that the control valve 15 does not open immediately upon energization of the actuator 30 or in the control valve 15 opening prematurely. Similarly, movement of the valve member 25 into engagement with its seating may be impaired.

Figure 3:
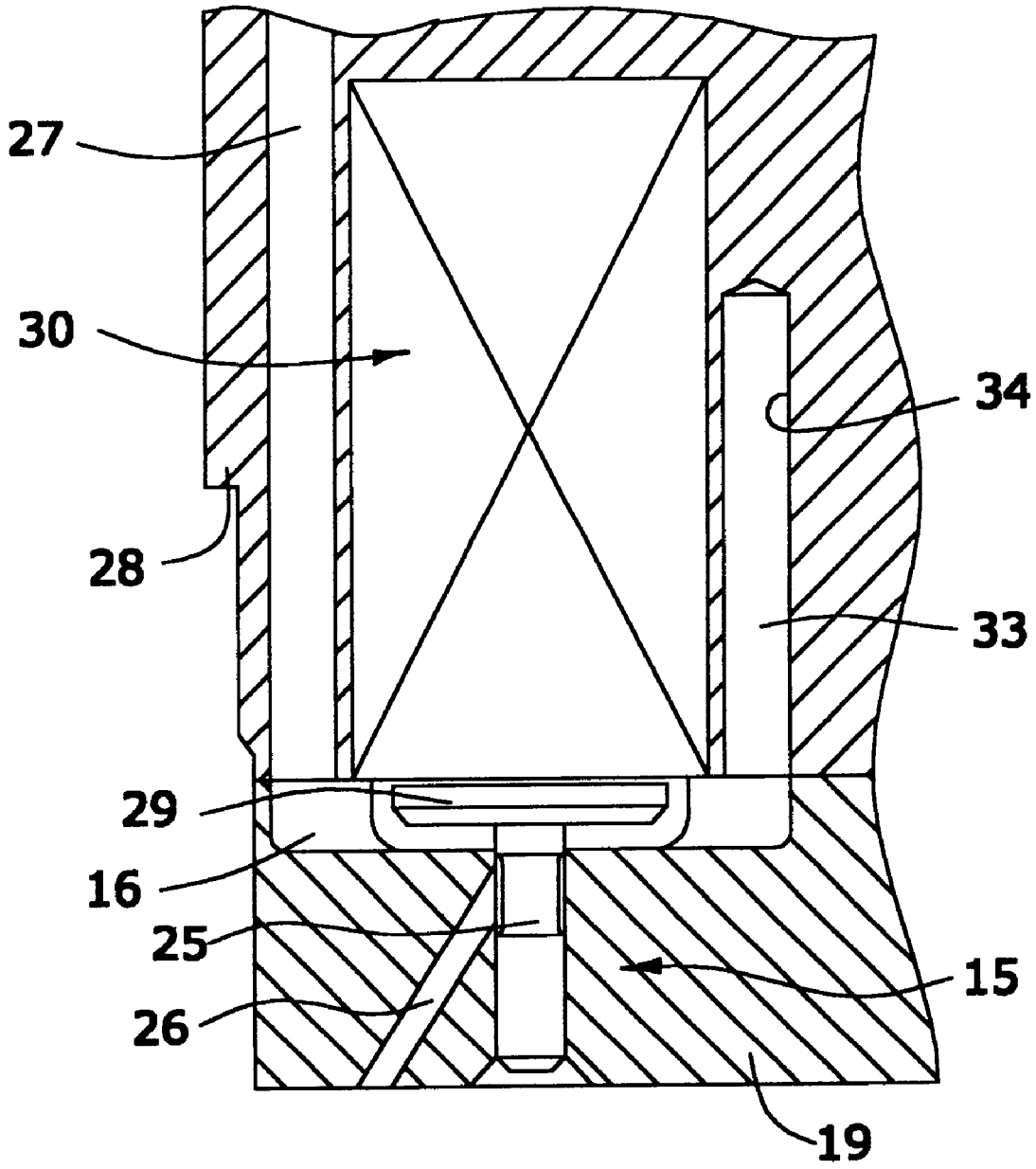
FIG. 3 is a view similar to FIG. 2 illustrating part of a fuel injector in accordance with an embodiment of the invention.

In accordance with the invention, a damping arrangement is provided in association with the low pressure chamber 16 to damp pressure waves, and hence reduce the risk of the operation of the control valve 15 being impaired. In the embodiment illustrated in FIG. 3, the damping arrangement comprises a volume 33 defined by a blind drilling 34 which extends adjacent the actuator 30 and which communicates with the low pressure chamber 16. The orientation of the blind drilling 34 is such that, in use, air or fuel vapour, or a mixture thereof, will become trapped within the drilling 34. The valve is operated in a vertical plane and the drilling is filled continuously by trapping fire bubbles which are separated during the violent fuel depressurisation which occurs within chamber 16. As such gases are readily compressible, pressure waves transmitted to the chamber 16 along the return passage 27 will be damped to a large extent by the presence of the compressible gases within the volume 33. The damping of the pressure waves applied to the low pressure chamber 16 reduces the risk of the performance of the control valve 15 being impaired, and as a result, consistent, reliable operation of the injector is more readily achievable.

Although in the description hereinbefore, the damping arrangement comprises a blind drilling which extends adjacent the actuator 30, it will be appreciated that other techniques may be used to damp the application of pressure waves to the low pressure chamber 16.

What is claimed is:

1. A fuel injector comprising a valve needle slidable within a bore, a surface associated with the valve needle being exposed to a fuel pressure within a control chamber, an electromagnetically actuable control valve controlling communication between the control chamber and a low pressure chamber, and a means for damping pressure waves applied to the low pressure chamber, said means for damping comprises a volume for containing gas, in use, the volume communicating with the low pressure chamber, the volume defined by a blind drilling in an actuator housing, said actuator housing defining a return passage and an actuator compartment having an actuator disposed therein, said blind drilling being oriented, in use, with its blind end uppermost to retain the gas therein, said blind drilling being separate and distinct from each of said return passage and said actuator compartment, said blind drilling further being spaced apart from said actuator and said actuator compartment by said actuator housing.

2. The fuel injector as claimed in claim/wherein the drilling extends generally parallel with part of an actuator for the control valve.

* * * * *